US005176265A

United States Patent [19]

Bennett

[11] Patent Number: 5,176,265

[45] Date of Patent: Jan. 5, 1993

[54] RETAINING STRUCTURE FOR PRESSURIZED GAS CYLINDERS

[76] Inventor: Richard C. Bennett, 4 Court of Chapelwood, Northbook, Ill. 60062

[21] Appl. No.: 879,893

[22] Filed: May 8, 1992

[51] Int. Cl.[5] ..... A47F 7/00

[52] U.S. Cl. ..... 211/71; 108/55.5; 137/376

[58] Field of Search ..... 211/71; 137/376; 108/55.1, 55.5; 248/680, 154, 127, 146, 313

[56] References Cited

U.S. PATENT DOCUMENTS

| | | | |
|---|---|---|---|
| 2,443,684 | 6/1948 | Lazarus . | |
| 2,526,009 | 10/1950 | Daniels . | |
| 2,669,409 | 2/1954 | Parsons . | |
| 3,217,892 | 11/1965 | Goodell . | |
| 3,266,765 | 8/1966 | Campbell . | |
| 3,414,311 | 12/1968 | Trimboli . | |
| 3,570,196 | 3/1971 | Kunczynski . | |
| 3,602,368 | 8/1971 | Gould . | |
| 3,643,813 | 2/1972 | Noonan . | |
| 3,791,403 | 2/1974 | Folkerth . | |
| 4,168,007 | 9/1979 | Rohatensky | 211/71 |
| 4,295,431 | 10/1981 | Stavlo . | |
| 4,481,972 | 11/1984 | Stavlo . | |
| 4,538,737 | 9/1985 | Delaney . | |
| 4,735,321 | 4/1988 | Day | 108/55.5 X |

FOREIGN PATENT DOCUMENTS

| | | | |
|---|---|---|---|
| 773948 | 1/1957 | United Kingdom | 108/55.5 |

*Primary Examiner*—Robert W. Gibson, Jr.
*Attorney, Agent, or Firm*—Emrich & Dithmar

[57] ABSTRACT

A retaining structure for a plurality of pressurized gas cylinders arranged in rows includes a lower frame having inner cross members fixed to upright posts and respectively disposed between adjacent rows of cylinders, and outer cross members along the outside of the outermost rows, the cross members having threaded studs at their outer ends for threaded coupling to a pair of end channels to form a rigid frame. An upper frame include generally V-shaped upper cross members arranged with two of them longitudinally aligned between each two adjacent rows of cylinders and threadedly coupled to the upper ends of upright rods which project upwardly from the inner cross members of the lower frame for holding the upper and lower frames in spaced relationship and maintaining the upper cross members in camming engagement with the sloping top walls of adjacent cylinders to wedge the cylinders against the cross members of the lower frame. Each upper cross member may be coupled to one or two upright rods. Each upright rod may be integral with an inner cross member of the lower frame or may be provided with a loop to slidably receive a hook to engage beneath the associated inner cross member of the lower frame.

20 Claims, 4 Drawing Sheets

RETAINING STRUCTURE FOR PRESSURIZED GAS CYLINDERS

BACKGROUND OF THE INVENTION

1. Field of the Invention

The present invention relates to holders or retainers for groups of pressurized gas cylinders to maintain them firmly in a predetermined array configuration.

2. Description of the Prior Art

Various types of pallets are known for holding a plurality of pressurized gas cylinders. Such pallets may be of the type designed for movement by forklift and/or may be in the form of a wheeled cart. Some such pallets are in the form of an upright, box-like, open cage which accommodates a plurality of cylinders. This arrangement provides greater stability than a simple flat pallet in that it limits tipping movement of the cylinders. But the cylinders must remain on the pallet for support. If they are removed from the pallet, some other means must be provided to hold them stably in a grouped array.

Furthermore, such open cage-type pallets do not serve to insure spacing between adjacent cylinders and, if the pallet is not substantially filled with cylinders, it will leave room for cylinders to tip and to bang against one another, necessitating the use of ropes or other lashing material to hold the cylinders upright and tightly together.

It is known to provide spacing bars on such cage-type pallets to separate the cylinders into adjacent rows, one such arrangement being disclosed in U.S. Pat. No. 3,602,368. But like other cage-type pallets, this device requires that the cylinders remain on the pallet.

It is also known to provide a framework for groups of upright pressure cylinders which maintains a predetermined spacing therebetween whether or not they are on a pallet. One such arrangement is disclosed in U.S. Pat. No. 3,643,813. This holder is a relatively complicated arrangement including a base member having a plurality of semi-cylindrical recesses for respectively accommodating cylinders and a plurality of gate elements which are hingedly connected to the base member for extending around the circumference of the cylinders to lock them in place. The arrangement is quite complicated and cumbersome. Furthermore, the device must be carefully dimensioned to accurately mate with the cylinders so as to tightly clamp them to support the device on the cylinders.

SUMMARY OF THE INVENTION

It is a general object of the present invention to provide an improved retaining structure for a plurality of pressurized gas cylinders, which avoids the disadvantages of prior cylinder support structures, while affording additional structural and operating advantages.

An important feature of the invention is the provision of a retaining structure which maintains an array of gas cylinders spaced apart in rows.

In connection with the foregoing feature, it is another feature of the invention to provide a retaining structure of the type set forth which is supported by the gas cylinders.

Another feature of the invention is the provision of a retaining structure of the type set forth which is readily adaptable for use with different numbers of cylinders.

Still another feature of the invention is the provision of a retaining structure of the type set forth which is of simple and economical construction and is readily disassembled.

These and other features of the invention are attained by providing retaining structure for a plurality of pressurized gas cylinders arranged in rows, comprising: a lower frame including at least one inner cross member disposable between adjacent rows of cylinders and two outer cross members disposable respectively along the outside of the outermost rows of cylinders, and means interconnecting said cross members to form a rigid framework confining the cylinders; an upper frame including at least one upper cross member disposable between adjacent rows of cylinders; and upright means releasably interconnecting said upper and lower frames and maintaining them in vertically spaced relationship; at least one of said upper and lower frames being disposed in supported engagement with the gas cylinders.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 1:
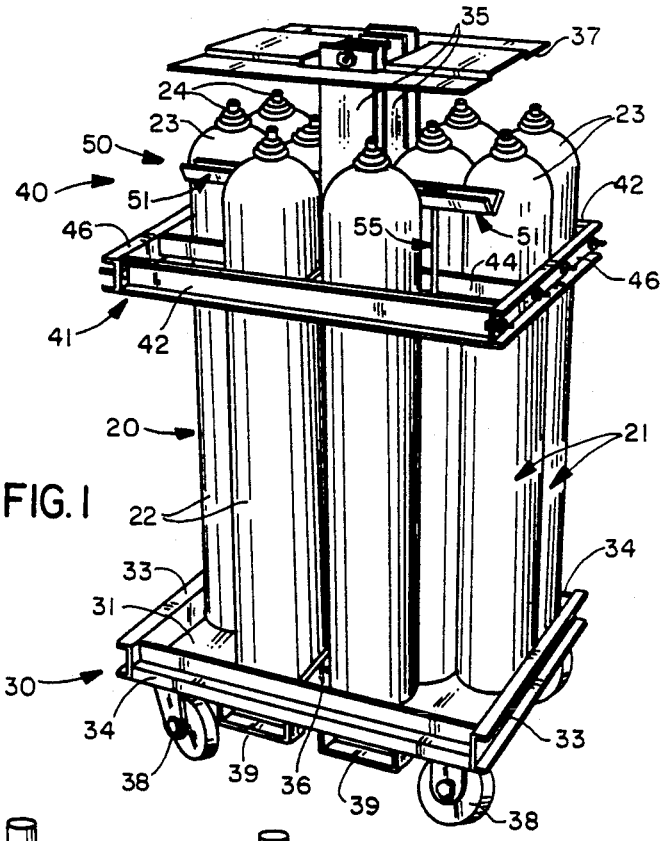
FIG. 1 is a perspective view of an array of a plurality of pressurized gas cylinders supported on a twelve-cylinder cart and held together by retaining structure constructed in accordance with a first embodiment of the present invention.
Figure 2:
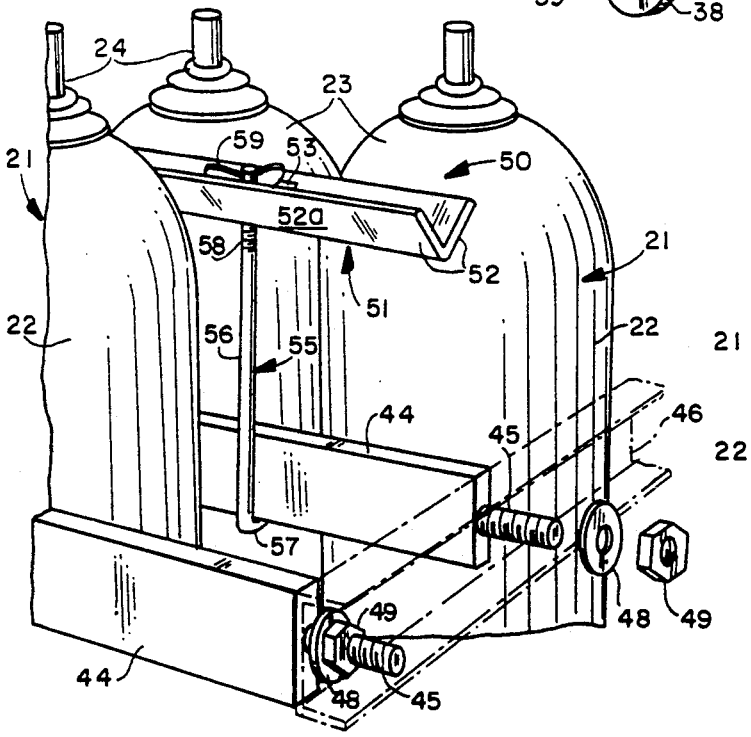
FIG. 2 is an enlarged, fragmentary, perspective view of a portion of the array of cylinders illustrated in FIG. 1, and illustrating disassembly of a portion of the retaining structure.
Figure 3:
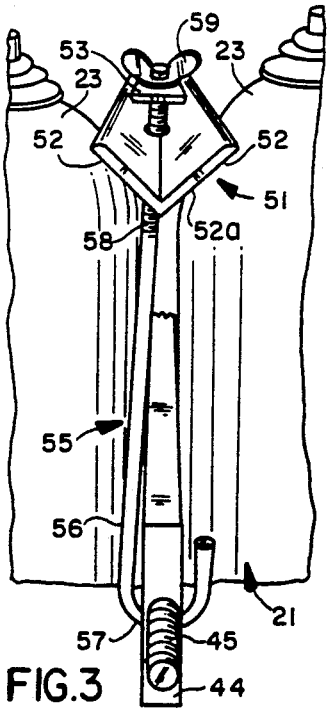
FIG. 3 is a fragmentary perspective view of a portion of the retaining structure of FIG. 2 viewed from the right-hand end thereof.

Referring to FIGS 1-3, there is illustrated an array 20 of a plurality of pressurized gas cylinders 21 arranged substantially in a grid pattern of rows and columns. Each of the cylinders 21 is of standard construction, having a cylindrical sidewall 22, closed at the bottom by a substantially flat bottom wall (not shown) and at the upper end by a rounded, sloping top wall 23 which converges upwardly toward the longitudinal axis of the cylinder and terminates in a suitable valve structure 24, which may be disposed in a bonnet (not shown). In use, the valve structures 24 of the several cylinders 21 may be interconnected by a suitable manifold including tubing and associated fittings (not shown) for connecting the cylinders 21 into a fluid distribution system, the fittings being separable when necessary to permit substitution of charged cylinders for spent cylinders in the array 20.

Figure 4:
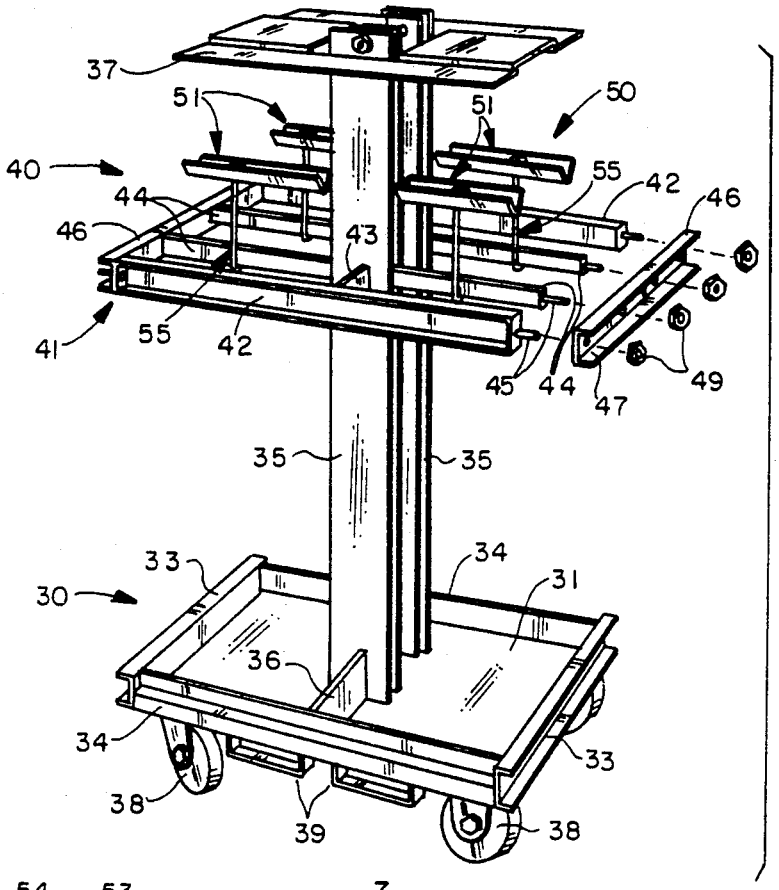
FIG. 4 is a perspective view similar to FIG. 1 with the cylinders removed and part of the retaining structure disassembled.

The array 20 is illustrated as being supported on a cart 30. Referring also to FIG. 4, the cart 30 has a flat, rectangular floor or bottom wall 31 provided at opposite ends thereof with upstanding end rails 33 and provided along the opposite sides thereof with upstanding side rails 34. Protecting upwardly from the floor 31 centrally thereof are a pair of upstanding, laterally spaced-apart posts 35, respectively connected to the side rails 34 by upstanding cross rails 36. Fixedly secured to the posts 35 adjacent to their upper ends is a generally rectangular cover 37 disposed substantially parallel to the floor 31. The cart 30 is provided with a plurality of wheels 38 and two pairs of fork tunnels 39 (one pair shown), respectively depending from opposite sides of the cart 30 to accommodate the tines of a fork lift and to provide stiffening for the cart 30. The cross rails 36 and the posts 35 cooperate with the end rails 33 and the side rails 34 to define a pair of compartments, each accommodating two columns of the cylinders 21, the illustrated cart 30 being designed to accommodate three of the cylinders 21 in each column, for a total of twelve cylinders. However, only ten of the cylinders 21 have been illustrated in FIG. 1, arranged in two rows of four cylinders each and one row of two cylinders.

Figure 8:
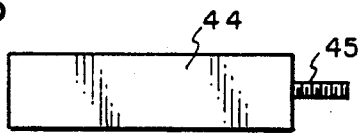
FIG. 8 is a side elevational view of a lower cross bar of the retaining structure of FIG. 4.
Figure 9:
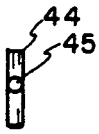
FIG. 9 is an end elevational view of the cross member of FIG. 8 viewed from the right-hand end thereof.

There is also illustrated a retaining structure 40, constructed in accordance with and embodying the features of a first embodiment of the present invention. The retaining structure 40 includes a lower frame 41 and an upper frame 50 interconnected by upright J-hooks 55. The lower frame 41 includes two exterior cross bars 42, each being generally channel-shaped in transverse cross section and respectively disposed along the outside of the outermost rows of the cylinders 21, substantially parallel to the side rails 34. Referring also to FIGS. 8 and 9, the lower frame 41 also includes a pair of interior cross bars 44, shaped similarly to the exterior cross bars 42 and disposed parallel thereto and respectively between the first and second and second and third rows of cylinders 21. Each of the interior cross bars 44 has an inner end fixedly secured, as by welding, to an associated one of the posts 35. Each of the exterior and interior cross bars 42 and 44 is provided at the outer end thereof with an externally threaded and longitudinally outwardly projecting end stud 45. The lower frame 41 also includes a pair of end channels 46, each having formed therethrough a plurality of equidistantly spaced-apart holes 47 (FIG. 4) at least as great in number as the total number of cross bars 42 and 44. The end channels 46 are disposed respectively along the opposite ends of the cross bars 42 and 44, with the end studs 45 being respectively received through the holes 47 in the end channels 46 and fixedly secured thereto by washers 48 and nuts 49, as illustrated in FIGS. 1, 2 and 4, to form a rigid framework which confines the array 20 of cylinders 21 in three rows. Thus, it will be appreciated that the lower frame 41 cooperates with the cross rails 36 of the cart 30 to snugly hold the array 20 of cylinders 21 in a grid pattern of rows and columns, with the inner two of the columns being separated by the cross rails 36 and with the row being separated by the interior cross bars 44.

Figure 5:
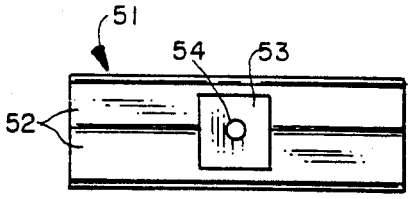
FIG. 5 is a top plan view of an upper cross member of FIG. 4.
Figure 6:
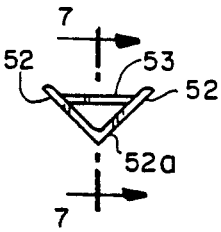
FIG. 6 is an end elevational view of the cross member of FIG. 5.
Figure 7:
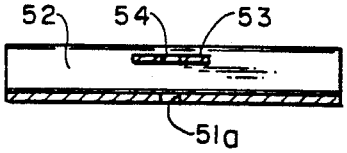
FIG. 7 is a view in vertical section taken along the line 7—7 in FIG. 6.

Referring also to FIGS. 5-7, the upper frame 50 includes four upper cross bars 51, each being generally V-shaped in transverse cross section, and being respectively disposed above the interior cross bars 44 substantially parallel thereto, i.e., between the first and second and second and third rows of cylinders 21. More specifically, each of the upper cross bars 51 has a pair of downwardly converging walls 52, interconnected adjacent to their upper ends longitudinally centrally thereof by a rectangular gusset 53, which may be fixedly secured to the walls 52, as by welding. Preferably, the gusset 53 is disposed substantially parallel to the line which defines the vertex of the V-shaped cross section of the cross bar 51. The gusset 53 has a hole 54 therethrough and the cross bar 51 has an hole 51*a* through the vertex thereof, aligned coaxially with the hole 54. The outer surfaces of the walls 52 respectively define cam surfaces 52*a* which, in use, engage the sloping top walls 23 of the cylinders 21 in adjacent rows, as can best be seen in FIGS. 1-3. It can be seen that between adjacent rows of the cylinders 21 there are disposed two longitudinally-aligned ones of the upper cross bars 51, spaced apart by one of the posts 35.

Figure 10:
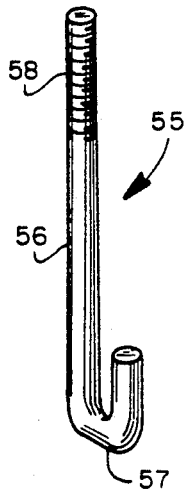
FIG. 10 is a perspective view of an upright member of the retaining structure of FIG. 4.

Referring also to FIG. 10, the upright J-hooks 55 are in the form of a plurality of elongated rods 56, respectively associated with the interior cross bars 44. Each of the rods 56 has a hook end 57 and an externally threaded end 58.

In use, the hook ends 57 of the J-hooks 55 are respectively hooked beneath corresponding ones of the lower frame cross bars 44, longitudinally centrally thereof, as illustrated in FIGS. 1-4, so that the upright rod 56 of each hook 55 will be disposed centrally of a cluster of four of the cylinders 21. The threaded ends 58 of the J-hooks 55 are received through the aligned holes 51*a* and 54 in corresponding ones of the upper cross bars 51, which are respectively aligned parallel to the interior cross bars 44, so that the cam surfaces 52*a* engage the sloping top walls 23 of the adjacent cylinders 21. Wing nuts 59 are then respectively threadedly engaged with the threaded ends 58 and are screwed down to wedge the upper cross bars 51 into camming engagement with the associated cylinders 21. This serves to support the upper cross bars 51 on the cylinders 21 and serves to draw the upper cross bars 51 downwardly so that the hook ends 57 tightly engage the associated interior cross bars 44 and so that the upper cross bars 51 wedge between the cylinders 21 of adjacent rows to cooperate with the exterior cross bars 42 firmly to hold the cylinders 2 in their upright positions and to prevent tilting or rattling thereof. This arrangement also serves to provide a rigid assembly of the upper frame 50 to the lower frame 41.

It is a significant aspect of the present invention that the retaining structure 40 serves to retain the array 20 of cylinders 21 in an upstanding condition without tilting or rattling. If the lengths of the cross bars 42 and 44 are equal to four times the diameter of one of the cylinders 21, and the spacings between adjacent stud holes in the end channels 46 are exactly equal to the diameter of one of the cylinders 21 plus the width of one of the interior cross bars 44, then the lower frame 41, when secured in place, will tightly clamp against the array 20 of cylinders 21 and hold them upright, if it is a complete array of twelve cylinders. However, it is a significant aspect of the present invention that it is not necessary that the lengths of the cross bars 42 and 44 and the spacings of the stud holes in the end channels 46 accurately correspond to the size of the cylinders 21, nor is it necessary for the cart 30 to be filled with cylinders 21. Thus, even if there is substantial "play" or free space between the cylinders 21 and the members of the lower frame 41, the array 20 will still be held firmly in place. In this regard, it will be noted that the wedging engagement of the upper cross bars 51 with the top walls 23 of the cylinders 21 cooperates with the exterior cross bars 42 of the lower frame 41 to take up any slack between adjacent rows of the cylinders 21, thereby providing a snug retention of the cylinders 21 in the retaining structure 40.

Figure 11:
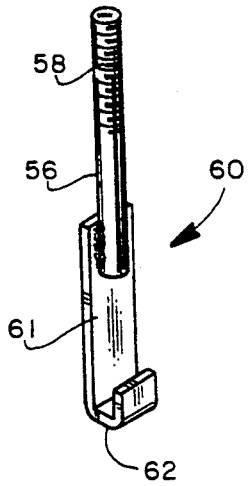
FIG. 11 is a perspective view of an alternative form of the upright member of FIG. 10.

Referring to FIG. 11, there is illustrated an alternative form of J-hook, generally designated by the numeral 60, which is similar to the J-hook 55 and has like portions bearing the same reference numbers. Thus, the J-hook 60 has an upstanding rod 56 with an externally threaded upper end 58. In this case, however, the rod 56 is substantially shorter than in the J-hook 55 and is fixedly secured, as by welding, at its lower end to the upper end of a depending flat bar 61, which is provided with a hook end 62 at its lower end. The J-hook 60 operates in exactly the same manner as was described above in connection with the J-hooks 55, except that it provides a wider surface engagement with the associate interior cross bars 44.

Figure 12:
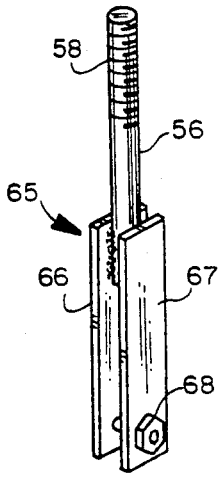
FIG. 12 is a perspective view of an alternative form of upright member for use with the retaining structure of FIG. 4.

In FIG. 12, there is illustrated an alternative form of upright 65 which also includes a rod 56 with an externally threaded upper end 58. In this case, the lower end of the rod 56 is fixedly secured, as by welding, at diametrically opposed locations thereon with two depending, parallel, flat plates 66 and 67, interconnectable at their lower ends by a bolt 68 and associated nut (not shown). In use, the plates 66 and 67 cooperate with the bolt 68 and the rod 56 to form a loop. With the bolt 68 removed, the upright 65 may be simply dropped over the associated one of the cross bars 44, with the flat plates 66 and 67 straddling the cross bars 44, the bolt 68 then being mounted in place to close the loop and secure the assembly together.

Figure 14:
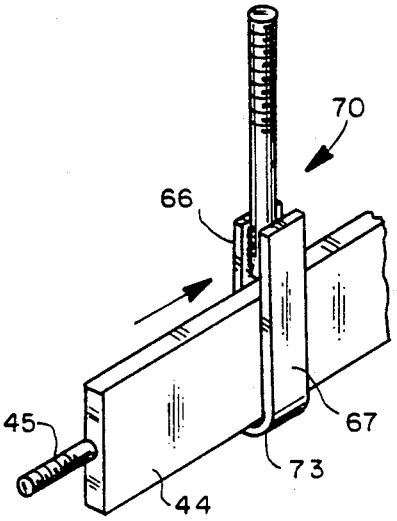
FIG. 14 is a perspective view illustrating cooperation of the upright member of FIG. 13 with an associated lower cross member of the retaining structure of FIG. 4.
Figure 13:
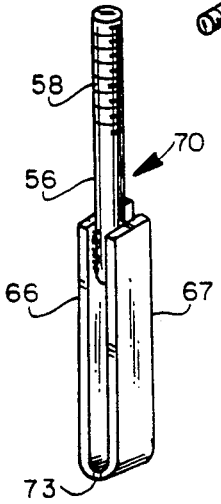
FIG. 13 is a perspective view of an alternative form of the upright member of FIG. 12.

In FIGS. 13 and 14, there is illustrated an alternative form of loop upright 70, which is substantially the same as the upright 65, except that the lower ends of the flat plates 66 and 67 are interconnected by an integral arcuate bight 73. This type of loop upright can be slipped over the outer end of the associated one of the interior cross bars 44 after the end channel 46 has been removed, as illustrated in FIG. 14.

Figure 15:
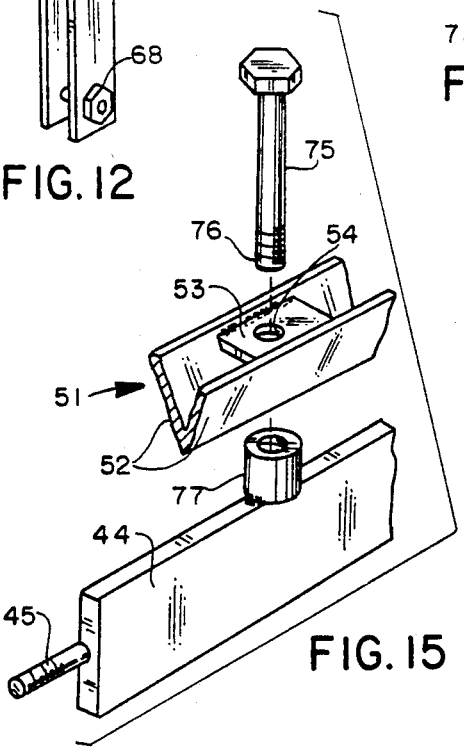
FIG. 15 is a perspective, exploded view of an alternative interconnection of the upper and lower frames of the retaining structure of FIG. 4.

In FIG. 15, there is illustrated still another arrangement for interconnecting the parts of the retaining structure 40. In this case, the J-hooks 55 are replaced by headed bolts 75, which are provided with externally threaded distal ends 76 which are passed downwardly through the aligned holes 54 and 51*a* in the associated upper cross bar 51 and are then threaded into externally threaded sockets 77, which are respectively fixedly secured, as by welding, to the upper edges of the interior cross bars 44 intermediate the ends thereof.

Figure 16:
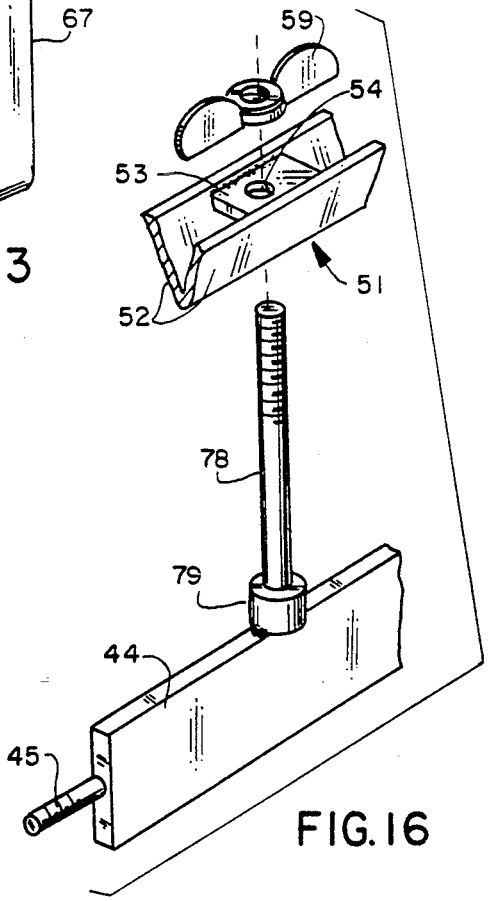
FIG. 16 is a view similar to FIG. 15, showing a still further alternative arrangement for interconnecting the upper and lower frames of the retaining structure of FIG. 4.

In FIG. 16, there is illustrated another variation, wherein upstanding studs 78 are respectively fixedly secured, as by weldments 79, to the upper edges of the interior cross bars 44 intermediate the ends thereof. Each of the studs 78 is provided with an externally threaded upper end which is passed through the aligned holes 51*a* and 54 in the associated upper cross bar 51 for engagement with the wing nut 59.

Figure 17:
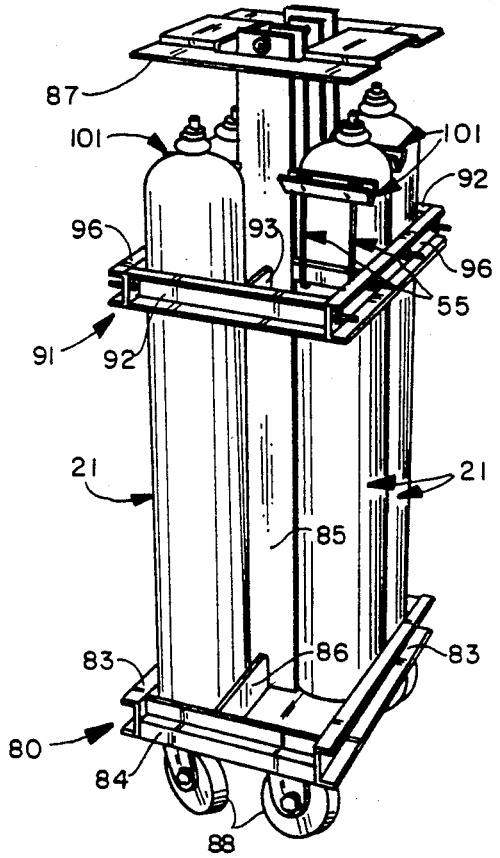
FIG. 17 is a view similar to FIG. 1, illustrating a six-cylinder cart with retaining structure constructed in accordance with a second embodiment of the present invention.
Figure 18:
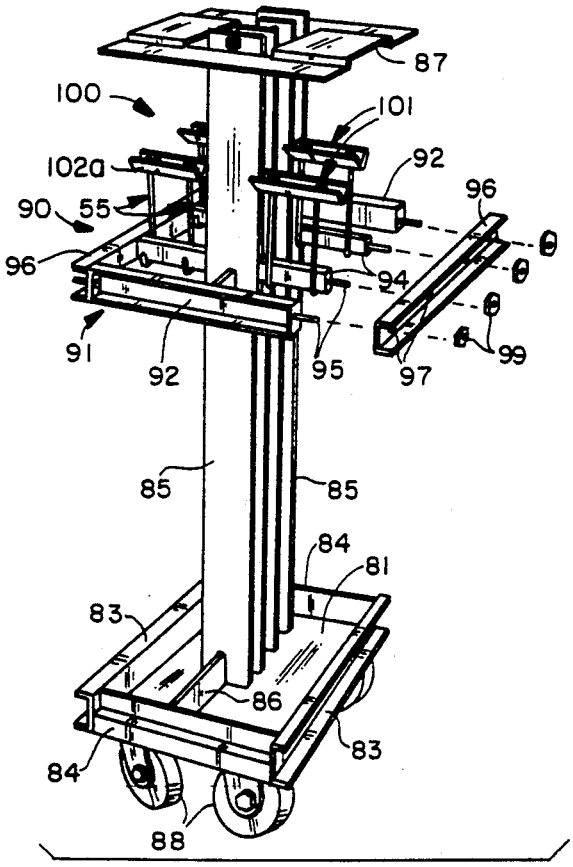
FIG. 18 is a perspective view similar to FIG. 17, with the cylinders removed and part of the retaining structure disassembled.
Figure 19:
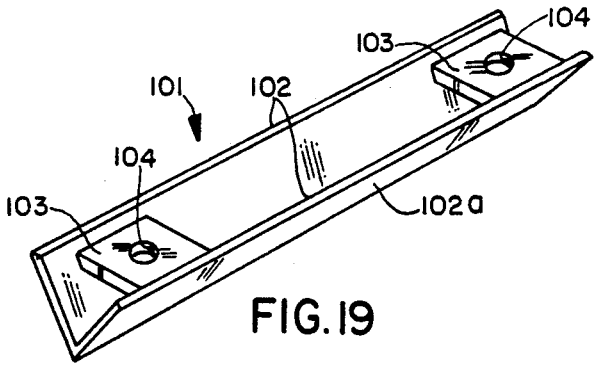
FIG. 19 is an enlarged, perspective view of an upper cross member of the retaining structure of FIG. 18.

Referring now to FIGS 17–19, there is illustrated an alternative form of the invention usable with a six-cylinder array. More specifically, there is disclosed a cart 80 having a rectangular floor 81 and provided at its opposite ends with upstanding end rails 83 and provided at its opposite sides with upstanding side rails 84. Fixedly secured to the floor 81 centrally thereof and projecting upwardly therefrom are a pair of upstanding, laterally spaced-apart posts 85, the lower ends of which are respectively connected to the side rails 84 by upstanding cross rails 86. The cart 80 is provided with a plurality of wheels 88, and may also be provided with depending fork tunnels (not shown) in a known manner. It can be seen that the posts 85 and the cross rails 86 cooperate with the end rails 83 and the side rails 84 to divide the cart 80 into a pair of compartments, each accommodating a column of three cylinders 21 for a total of six cylinders.

The cart 80 is provided with retaining structure 90 in accordance with a second embodiment of the invention. More specifically, the retaining structure 90 includes a lower frame 91, which is substantially the same as the lower frame 41 described above in connection with FIGS. 1–4, except that it is shorter. The lower frame 91 includes a pair of exterior cross bars 92, generally channel-shaped in transverse cross section, and designed to extend along the outer sides of the outermost rows of cylinders 21, the cross bars 92 being respectively connected to the posts 85 by side webs 93. The lower frame 91 also includes two pairs of interior cross bars 94, each having an inner end fixedly secured, as by welding, to an associated one of the posts 85. Each of the exterior and interior cross bars 92 and 94 is provided at the outer end thereof with an externally threaded and longitudinally outwardly projecting end stud 95. The lower frame 9; also includes a pair of end channels 96, each having formed therethrough a plurality of equidistantly spaced-apart holes 97 at least as great in number as the total number of cross bars 92 and 94. The end channels 96 are disposed respectively along the opposite ends of the cross bars 92 and 94 with the end studs 95 being respectively received through the holes 97 in the end channels 96 and fixedly secured thereto by washers (not shown) and nuts 99, to form a rigid framework which confines the array of cylinders 21 in three rows. Thus, it will be appreciated that the lower frame 91 cooperates with the cross rails 86 of the cart 80 to snugly hold the array of cylinders 21 in a grid pattern of rows and columns with the columns being separated by the cross rails 86 and with the rows being separated by the interior cross bars 94.

The retaining structure 90 also includes an upper frame 100, which includes four upper cross bars 101, each being generally V-shaped in transverse cross section, and being respectively disposed above the interior cross bars 94, substantially parallel thereto, i.e., between the first and second and second and third rows of cylinders 21. More specifically, each of the upper cross bars 101 has a pair of downwardly converging walls 102, interconnected adjacent to their upper ends by a pair of longitudinally spaced-apart, rectangular gussets 103, which may be fixedly secured to the walls 102, as by welding. Preferably, the gussets 103 are substantially coplanar and disposed substantially parallel to the line which defines the vertex of the V-shaped cross section of the cross bars 101. Each of the gussets 103 has a hole 104 therethrough and the cross bar 101 has two holes (not shown) through the vertex thereof, respectively aligned coaxially with the holes 104. The outer surfaces of the walls 102 respectively define cam surfaces **102*a* which, in use, engage the sloping top walls 23 of the cylinders 21 in adjacent rows, as can best be seen in FIG. 17**.

In use, the upper frame 100 is interconnected with the lower frame 91 by J-hooks 55 in substantially the same manner as was described above in connection with the retaining structure 40. However, in this case, each of the upper cross bars 101 is coupled to an associated one of the exterior cross bars 92 by two of the J-hooks 55. More particularly, the J-hooks 55 with each of the upper cross bars 101 are spaced apart a distance slightly less than the diameter of one of the cylinders 21, so that, in use, they are respectively disposed closely adjacent to the associated post 85 and the associated end channel 96, at locations where the cylindrical walls of adjacent cylinders 21 diverge sufficiently to accommodate them. It can be seen that adjacent rows of the cylinders 21 are separated by two longitudinally-aligned ones of the upper cross bars 101, separated by the associated one of the posts 85. The wedging action of the upper frame 100 is substantially the same as that described above in connection with the retaining structure 40, except that each of the upper cross bars 101 is disposed in wedging engagement with only two of the cylinders 21.

From the foregoing, it can be seen that there has been provided an improved retaining structure for an array of gas cylinders, which is of simple and economical construction and which firmly holds the array upright without tilting or rattling on an associated cart, and without the requirement for precisely dimensioned parts.

I claim:

1. Retaining structure for a plurality of pressurized gas cylinders arranged in rows, comprising: a lower frame including at least one inner cross member disposable between adjacent rows of cylinders and two outer cross members disposable respectively along the outside of the outermost rows of cylinders, and means interconnecting said cross members to form a rigid framework confining the cylinders; an upper frame including at least one upper cross member disposable between adjacent rows of cylinders; and upright means releasably interconnecting said upper and lower frames and maintaining them in vertically spaced relationship; at least one of said upper and lower frames being disposed in supported engagement with the gas cylinders.

2. The retaining structure of claim 1, wherein said cross members are all substantially parallel to one another.

3. The retaining structure of claim 1, wherein said lower frame includes a plurality of said inner cross members and said upper frame includes a plurality of said upper cross members.

4. The retaining structure of claim 1, wherein said upper frame includes two cross members disposed in longitudinal alignment with each other between two adjacent rows of cylinders.

5. The retaining structure of claim 1, wherein said upright means includes at least one upright member connected to each of said upper cross members.

6. The retaining structure of claim 5, wherein said upright means includes two upright members connected to each of said upper cross members.

7. The retaining structure of claim 1, and further comprising means releasably connecting said upright means to said upper frame.

8. The retaining structure of claim 7, wherein said means releasably connecting includes threaded means.

9. The retaining structure of claim 7, and further comprising means for releasably connecting said upright means to said lower frame.

10. The retaining structure of claim 9, wherein said upright means includes a J-shaped member having a hook at the lower end thereof engageable beneath an associated one of said inner cross members of said lower frame.

11. The retaining structure of claim 9, wherein said upright means includes an elongated rod having a loop at the lower end thereof for receiving therethrough an associated one of said inner cross members of said lower frame.

12. Retaining structure for a plurality of pressurized gas cylinders arranged in rows, wherein each cylinder has a rounded top wall sloping upwardly toward the longitudinal axis of the cylinder, comprising: a lower frame including at least one inner cross member disposable between adjacent rows of cylinders and two outer cross members disposable respectively along the outside of the outermost rows of cylinders, and means interconnecting said cross members to form a rigid framework confining the cylinders; an upper frame including at least one upper cross member disposable between adjacent rows of cylinders, said upper cross member having camming surfaces respectively disposable in camming engagement with the sloping top walls of the cylinders of adjacent rows; and upright means releasably interconnecting said upper and lower frames and maintaining them in vertically spaced relationship, said upright means cooperating with said upper frame to hold said cam surfaces in wedging engagement with the top walls of the cylinders of adjacent rows to support said upper frame on the cylinders and to firmly urge the cylinders against said cross members of said lower frame.

13. The retaining structure of claim 12, wherein said upper cross member is generally V-shaped in transverse cross section, including a pair of sloping walls converging to a vertex, said camming surfaces being respectively formed on said sloping walls.

14. The retaining structure of claim 13, wherein said upper cross member has an aperture therethrough.

15. The retaining structure of claim 14, and further comprising gusset means interconnecting the walls of said upper cross member, said gusset means having a hole therethrough aligned with said aperture.

16. The retaining structure of claim 15, wherein said upright means includes means receivable through the aligned hole and aperture of said upper cross member and releasably connected thereto.

17. The retaining structure of claim 16, wherein said upright means is releasably connected to said lower frame.

18. The retaining structure of claim 12, wherein said upright means includes means releasably coupled to said lower frame.

19. The retaining structure of claim 18, wherein said upright means includes a J-shaped member having a hook at the lower end thereof engageable beneath an associated one of said inner cross members of said lower frame.

20. The retaining structure of claim 12, wherein said upper frame includes two cross members disposed in longitudinal alignment with each other between two adjacent rows of cylinders.

* * * * *